US011653778B2

(12) United States Patent
Chen

(10) Patent No.: US 11,653,778 B2
(45) Date of Patent: May 23, 2023

(54) PAPER DRINKING STRAW

(71) Applicant: Forever Lucky Co., Ltd., Tainan (TW)

(72) Inventor: Mei-Jun Chen, Tainan (TW)

(73) Assignee: FOREVER LUCKY CO., LTD., Tainan (TW)

( * ) Notice: Subject to any disclaimer, the term of this patent is extended or adjusted under 35 U.S.C. 154(b) by 141 days.

(21) Appl. No.: 17/314,468

(22) Filed: May 7, 2021

(65) Prior Publication Data

US 2021/0345804 A1 Nov. 11, 2021

(30) Foreign Application Priority Data

May 8, 2020 (TW) ..... 109205558

(51) Int. Cl.
*A47G 21/18* (2006.01)

(52) U.S. Cl.
CPC ..... *A47G 21/189* (2013.01)

(58) Field of Classification Search
CPC ..... A47G 21/18; A47G 21/189
USPC ..... 239/33
See application file for complete search history.

(56) References Cited

U.S. PATENT DOCUMENTS 4,736,887 A * 4/1988 Inaba ..... A47G 21/189 239/33
4,850,533 A * 7/1989 Hoshi ..... A47G 21/189 239/33
2021/0244217 A1* 8/2021 Reynolds ..... A47G 21/189

* cited by examiner

*Primary Examiner* — Steven J Ganey
(74) *Attorney, Agent, or Firm* — Muncy, Geissler, Olds & Lowe, P.C.

(57) ABSTRACT

A paper drinking straw is provided, including a main tube and a sub-tube. The main tube includes a first neck segment, and the sub-tube is movably sleeved with the main tube. The sub-tube includes a second neck segment and is movable in a stretching direction to increase a length of the fourth segment protruding beyond the main tube. When the sub-tube is moved to a predetermined position, the second neck segment is restricted to the first neck segment, and the sub-tube is unmovable in the stretching direction.

9 Claims, 6 Drawing Sheets

PAPER DRINKING STRAW

BACKGROUND OF THE INVENTION

Field of the Invention

The present invention relates to a paper drinking straw.

Description of the Prior Art

Recently, with hand shake beverages become popular, the use of drinking straws is more extensive. Specifically, plastic drinking straws have advantages of low cost, lightweight and good durability so that the plastic drinking straws are frequently used. However, the plastic drinking straws are not biodegradable and inconvenient to be reused, which results in environmental pollution.

To reduce the pollution caused by the plastic drinking straws, drinking straws made of stainless steel, glass or silicone are provided. However, stainless steel drinking straws are relative heavy, high cost and inconvenient to clean; glass drinking straws are fragile; and silicone drinking straws are also inconvenient to clean and easy to absorb fluids and bacteria. In addition, a length of each of the drinking straws mentioned above is unchangeable, which is inconvenient to storage and carry.

The present invention is, therefore, arisen to obviate or at least mitigate the above-mentioned disadvantages.

SUMMARY OF THE INVENTION

The main object of the present invention is to provide a paper drinking straw which is convenient to storage and carry and is environmentally friendly and contributed to plastic waste reduction.

To achieve the above and other objects, the present invention provides a paper drinking straw, including: a main tube and a sub-tube. The main tube includes a first segment, a second segment and a first neck segment. An outer diametrical dimension of the first segment is larger than an outer diametrical dimension of the second segment. The first neck segment is connected between the first segment and the second segment, and the first neck segment is tapered in a direction from the first segment toward the second segment. The sub-tube is movably sleeved with the main tube and includes a third segment, a fourth segment and a second neck segment. An outer diametrical dimension of the third segment is larger than an outer diametrical dimension of the fourth segment. The second neck segment is connected between the third segment and the fourth segment, and the second neck segment is tapered in a direction from the third segment toward the fourth segment. The outer diametrical dimension of the third segment is smaller than or equal to an inner diametrical dimension of the first segment, and the outer diametrical dimension of the fourth segment is smaller than or equal to an inner diametrical dimension of the second segment. The sub-tube is movable in a stretching direction to increase a length of the fourth segment protruding beyond the second segment. When the sub-tube is moved to a predetermined position, the second neck segment is restricted to the first neck segment, and the sub-tube is unmovable in the stretching direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
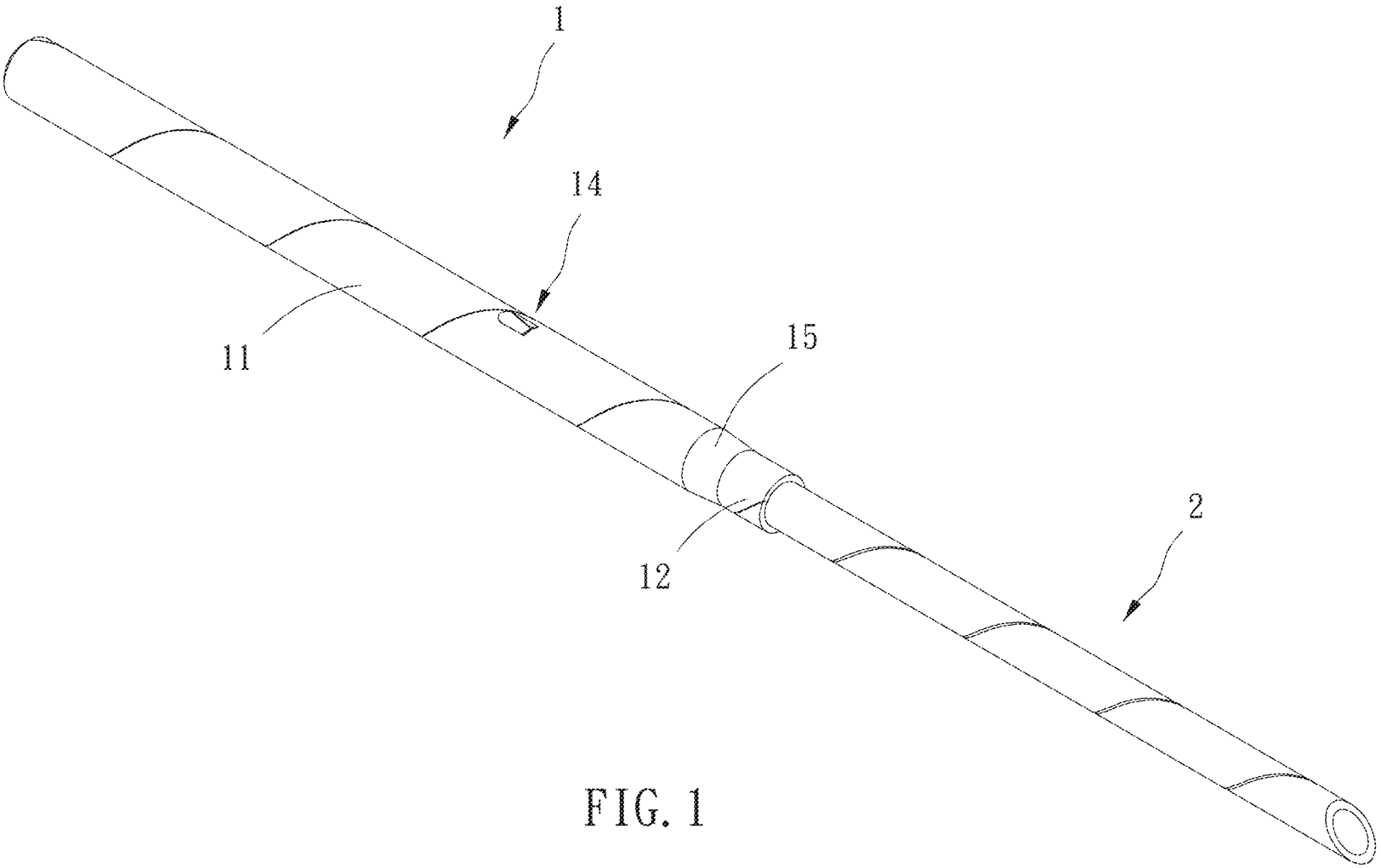
FIG. 1 is a stereogram of a preferable embodiment of the present invention.
Figure 2:
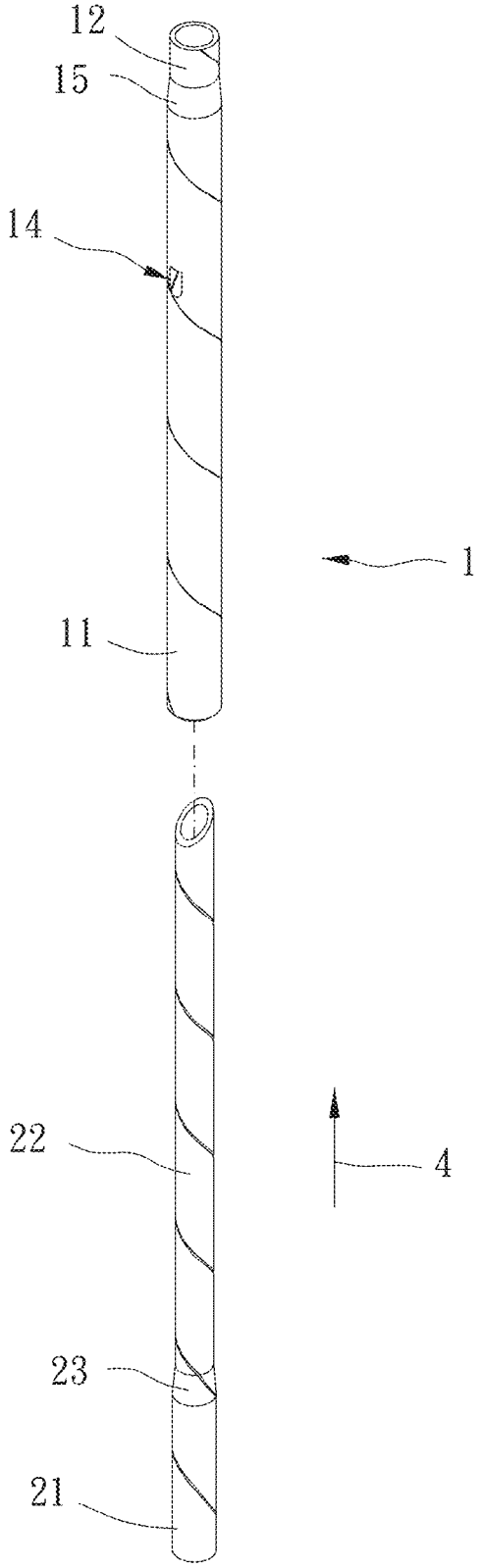
FIG. 2 is a breakdown drawing of a preferable embodiment of the present invention.
Figure 3:
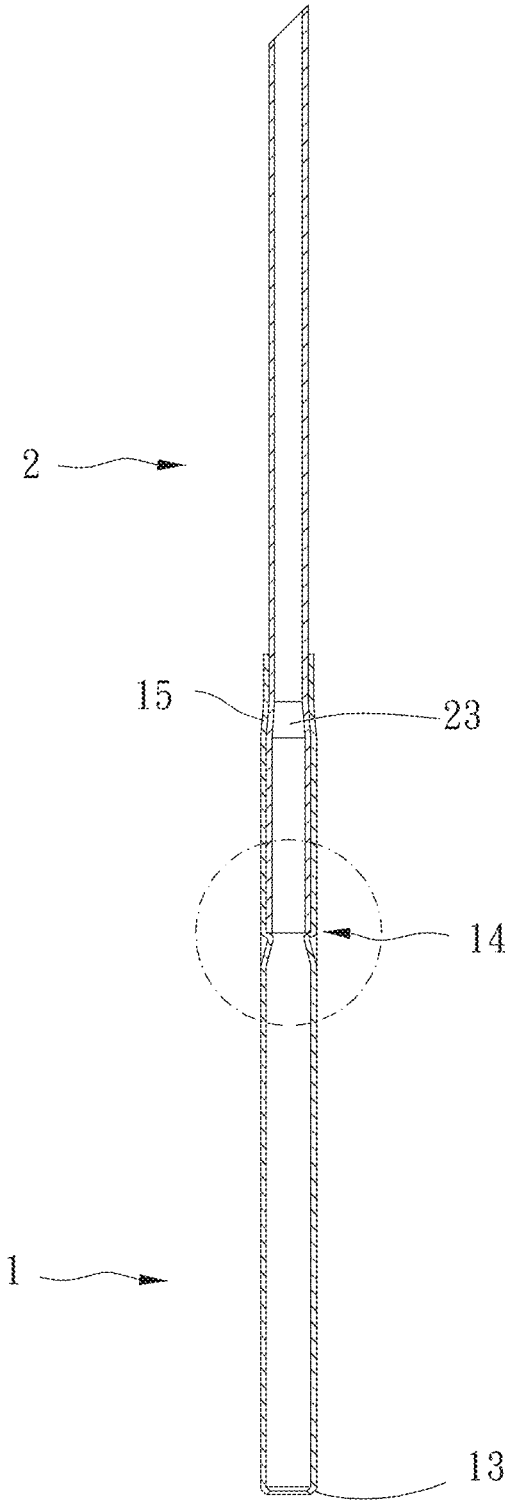
FIG. 3 is a cross-sectional view of a preferable embodiment of the present invention.
Figure 4:
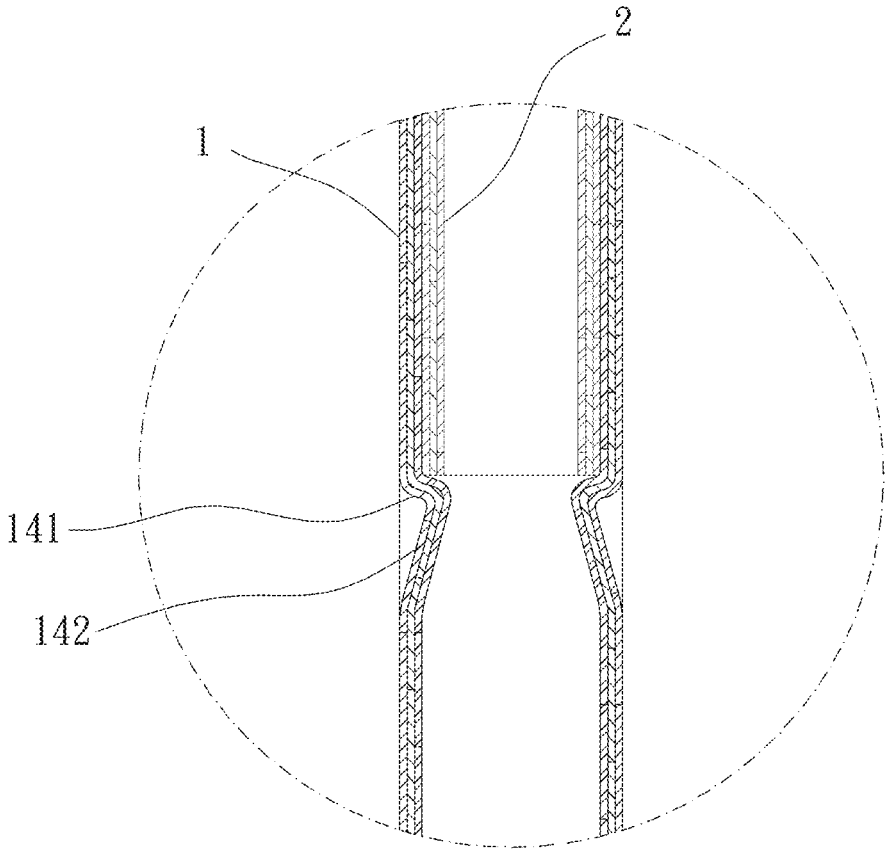
FIG. 4 is a partial enlargement of FIG. 3.

Please refer to FIGS. 1 to 6 for a preferable embodiment of the present invention. A paper drinking straw of the present invention includes a main tube 1 and a sub-tube 2.

The main tube 1 includes a first segment 11, a second segment 12 and a first neck segment 15. An outer diametrical dimension of the first segment 11 is larger than an outer diametrical dimension of the second segment 12. The first neck segment 15 is connected between the first segment 11 and the second segment 12, and the first neck segment 15 is tapered in a direction from the first segment 11 toward the second segment 12.

The sub-tube 2 is movably sleeved with the main tube 1 and includes a third segment 21, a fourth segment 22 and a second neck segment 23. An outer diametrical dimension of the third segment 21 is larger than an outer diametrical dimension of the fourth segment 22. The second neck segment 23 is connected between the third segment 21 and the fourth segment 22, and the second neck segment 23 is tapered in a direction from the third segment 21 toward the fourth segment 22. The outer diametrical dimension of the third segment 21 is smaller than or equal to an inner diametrical dimension of the first segment 11, and the outer diametrical dimension of the fourth segment 22 is smaller than or equal to an inner diametrical dimension of the second segment 12. The sub-tube 2 is movable in a stretching direction 4 to increase a length of the fourth segment 22 protruding beyond the second segment 12. When the sub-tube 2 is moved to a predetermined position, the second neck segment 23 is restricted to the first neck segment 15, and the sub-tube 2 is unmovable in the stretching direction 4.

Specifically, the first neck segment 15 and the second neck segment 23 are cone-shaped respectively so as to provide different strength of restriction force therebetween according to movement of the sub-tube 2 relative to the main tube 1 in the stretching direction 4. The longer the length of the fourth segment 22 protrudes beyond the second segment 12, the tighter the first neck segment 15 is restricted with the second neck segment 23, which provides good positioning effect.

Preferably, an end of the first segment 11 remote from the second segment 12 has a constricted portion 13, and the constricted portion 13 extends toward an interior of the first segment 11 and is blockable with the sub-tube 2 in a direction opposite to the stretching direction 4. In manufacturing, the sub-tube 2 is inserted within the main tube 1, and then the constricted portion 13 is formed to block the sub-tube 2 from removing from the main tube 1 in the direction opposite to the stretching direction 4. In other words, the main tube 1 effectively restricts the sub-tube 2 by the constricted portion 13 and the first neck segment 15 to prevent the sub-tube 2 from removing therefrom.

The main tube 1 further includes at least one blocking unit 14 protruding from an inner wall of the first segment 11. When the sub-tube 2 is received within the second segment 12, the third segment 21 is located at a side of the at least one blocking unit 14 remote from the second segment 12 and is interferable with the at least one blocking unit 14 in the stretching direction 4 so as to avoid unexpected movement of the sub-tube 2 relative to the main tube 1. When the sub-tube 2 is in the predetermined position, the at least one blocking unit 14 provides supporting force to the sub-tube 2 in the stretching direction 4. Therefore, the sub-tube 2 is non-retractable into the main tube 1 when the sub-tube 2 is inserted through an object (such as a sealing film of a beverage).

In this embodiment, the main tube 1 includes two said blocking units 14, and the two said blocking units 14 are arranged on radial opposite sides of the main tube 1 so as to stably support the sub-tube 2. Moreover, the first segment 11 has the two said blocking units recessed integrally and radially thereon, which is easy to be processed. In the stretching direction 4, a distance between one said blocking unit 14 and the first neck segment 15 is smaller than a distance between one said blocking unit 14 and the constricted portion 13.

Specifically, each said blocking unit 14 includes a blocking portion 141 and a connecting portion 142. Relative to an axial direction of the main tube 1, the blocking portion 141 extends obliquely toward an interior of the first segment 11 and is axially abuttable against the sub-tube 2, and the connecting portion 142 is connected with a side of the blocking portion 141 opposite to the first neck segment 15. Preferably, an acute angle between the axial direction and an extending direction of the blocking portion 141 is larger than an acute angle between the axial direction and an extending direction of the connecting portion 142, and a length of the blocking portion 141 is shorter than a length of the connecting portion 142. Therefore, the connecting portion 142 is easy to deform to allow the sub tube 2 to move to the predetermined position, and the blocking portion 141 can provide sufficient supporting force to avoid retraction of the sub tube 2.

Figure 5:
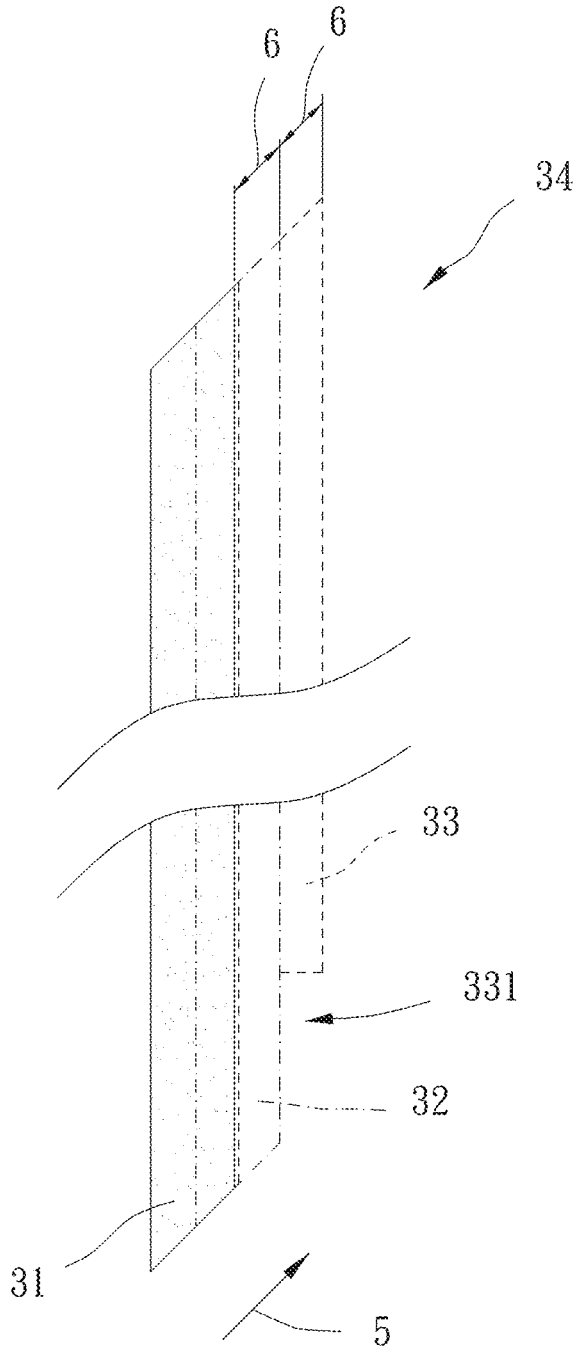
FIG. 5 is a drawing showing a paper substrate according to of a preferable embodiment of the present invention.
Figure 6:
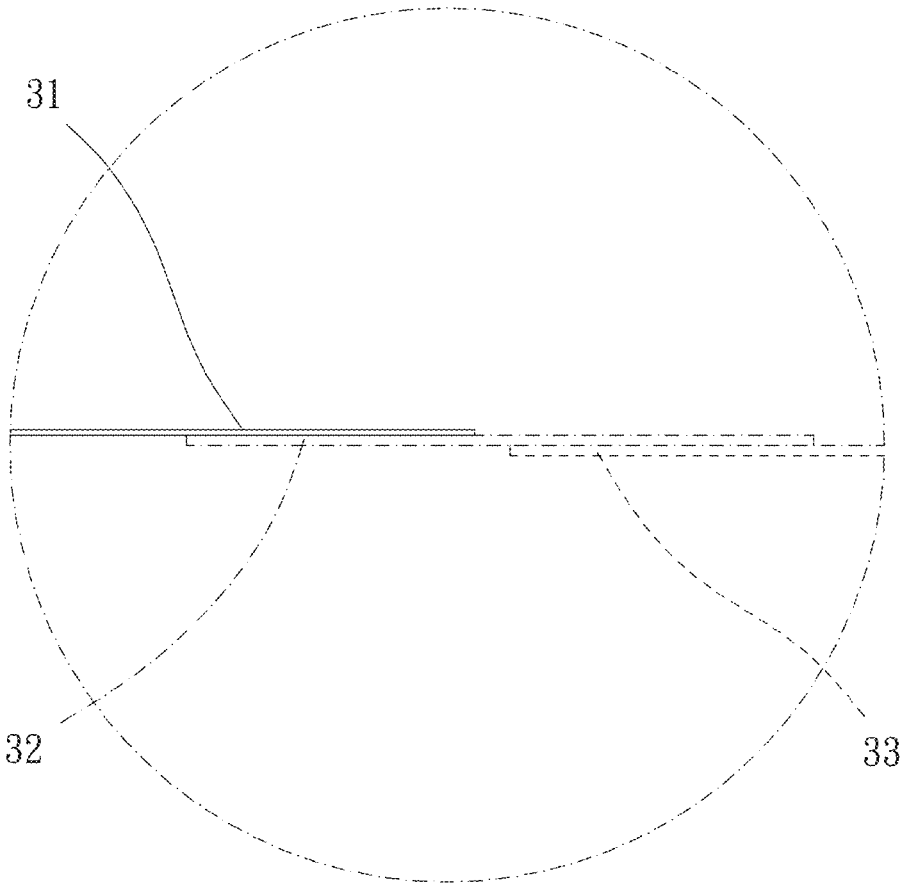
FIG. 6 is partial side view of FIG. 5.

Please refer to FIGS. 5 and 6, the main tube 1 includes a first paper layer 31, a second paper layer 32 and a third paper layer 33, and shapes of the first paper layer 31, the second paper layer 32 and the third paper layer 33 are parallelograms respectively. The first paper layer 31, the second paper layer 32 and the third paper layer 33 are partially overlapped with one another in sequence and dislocated from one another in a predetermined distance 6 along an arrangement direction 5 to form a paper substrate 34. The main tube 1 is formed by helically rolling up the paper substrate 34 so that the first paper layer 31, the second paper layer 32 and the third paper layer 33 are stacked layer by layer to provide good structural strength Furthermore, in the arrangement direction 5, a portion of the third paper layer 33 protruding beyond the second paper layer 32 has a notched portion 331 disposed thereon, and the first paper layer 31 covers the notched portion 331 after helically rolling up the paper substrate 34, so that the main tube 1 has a smooth end surface.

A thickness of the first paper layer 31 is smaller than a thickness of the second paper layer 32 and a thickness of the third paper layer 33. Preferably, the second paper layer 32 and the third paper layer 33 are entirely covered by the first paper layer 31. The first paper layer 31 is an outmost layer of the main tube 1, and the second paper layer 32 and the third paper layer 33 are inner layers of the main tube 1. In this embodiment, a color of the first paper layer 31 is different from a color of the second paper layer 32 and a color of the third paper layer 33, and the color of the second paper layer 32 and the color of the third paper layer 33 are the same.

In summary, the paper drinking straw of the present invention is made by helically rolling up three paper layers overlapped with one another, which is environmentally friendly and has good structural strength. In addition, the paper drinking straw is stretchable by configuration of the main tube and the sub-tube, which is convenient to storage and carry.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A paper drinking straw, including:

a main tube, including a first segment, a second segment and a first neck segment, an outer diametrical dimension of the first segment being larger than an outer diametrical dimension of the second segment, the first neck segment connected between the first segment and the second segment, the first neck segment tapered in a direction from the first segment toward the second segment; and a sub-tube, movably sleeved with the main tube, including a third segment, a fourth segment and a second neck segment, an outer diametrical dimension of the third segment being larger than an outer diametrical dimension of the fourth segment, the second neck segment connected between the third segment and the fourth segment, the second neck segment tapered in a direction from the third segment toward the fourth segment, the outer diametrical dimension of the third segment being smaller than or equal to an inner diametrical dimension of the first segment, the outer diametrical dimension of the fourth segment being smaller than or equal to an inner diametrical dimension of the second segment;

wherein the sub-tube is movable in a stretching direction to increase a length of the fourth segment protruding beyond the second segment, and when the sub-tube is moved to a predetermined position, the second neck segment is restricted to the first neck segment, and the sub-tube is unmovable in the stretching direction;

wherein the main tube includes a first paper layer, a second paper layer and a third paper layer which are partially overlapped with one another in sequence and dislocated from one another in a predetermined distance along an arrangement direction to form a paper substrate, and the main tube is formed by helically rolling up the paper substrate.

2. The paper drinking straw of claim 1, wherein an end of the first segment remote from the second segment has a constricted portion, and the constricted portion extends toward an interior of the first segment and is blockable with the sub-tube in a direction opposite to the stretching direction.

3. The paper drinking straw of claim 1, wherein the main tube further includes at least one blocking unit protruding from an inner wall of the first segment; and when the sub-tube is in the predetermined position, the at least one blocking unit is blockable with the sub-tube in a direction opposite to the stretching direction.

4. The paper drinking straw of claim 3, wherein the main tube includes two said blocking units, and the two said blocking units are arranged on radial opposite sides of the main tube.

5. The paper drinking straw of claim 3, wherein the first segment has the at least one blocking unit recessed integrally and radially thereon.

6. The paper drinking straw of claim 3, wherein each of the at least one blocking unit includes a blocking portion and a connecting portion, relative to an axial direction of the main tube, the blocking portion extends obliquely toward an interior of the first segment and is axially abuttable against the sub-tube, and the connecting portion is connected with a side of the blocking portion opposite to the first neck segment.

7. The paper drinking straw of claim 6, wherein a length of the blocking portion is shorter than a length of the connecting portion.

8. The paper drinking straw of claim 7, wherein an end of the first segment remote from the second segment has a constricted portion, and the constricted portion extends toward an interior of the first segment and is blockable with the sub-tube in a direction opposite to the stretching direction; the first segment has the at least one blocking unit recessed integrally and radially thereon; the main tube includes two said blocking units, and the two said blocking units are arranged on radial opposite sides of the main tube; in the arrangement direction, a portion of the third paper layer protruding beyond the second paper layer has a notched portion disposed thereon, and the first paper layer covers the notched portion after helically rolling up the paper substrate; a color of the first paper layer is different from a color of the second paper layer and a color of the third paper layer, and the color of the second paper layer and the color of the third paper layer are the same; a thickness of the first paper layer is smaller than a thickness of the second paper layer and a thickness of the third paper layer; shapes of the first paper, the second paper layer and the third paper layer are parallelograms respectively; the second paper layer and the third paper layer are entirely covered by the first paper layer, the first paper layer is an outmost layer of the main tube, and the second paper layer and the third paper layer are inner layers of the main tube; in the stretching direction, a distance between one said blocking unit and the first neck segment is smaller than a distance between one said blocking unit and the constricted portion; and the first neck segment and the second neck segment are cone-shaped respectively.

9. The paper drinking straw of claim 1, wherein in the arrangement direction, a portion of the third paper layer protruding beyond the second paper layer has a notched portion disposed thereon, and the first paper layer covers the notched portion after helically rolling up the paper substrate.

* * * * *